US007694360B2

(12) United States Patent
Tally

(10) Patent No.: US 7,694,360 B2
(45) Date of Patent: Apr. 13, 2010

(54) SUPPORT AND TRANSFER APPARATUS FOR TRANSPORT OF AN INCAPACITATED INDIVIDUAL

(75) Inventor: Kevin L. Tally, Clarinda, IA (US)

(73) Assignee: EZ Way, Inc., Clarinda, IA (US)

( * ) Notice: Subject to any disclaimer, the term of this patent is extended or adjusted under 35 U.S.C. 154(b) by 0 days.

(21) Appl. No.: 11/521,688

(22) Filed: Sep. 15, 2006

(65) Prior Publication Data

US 2007/0006381 A1 Jan. 11, 2007

Related U.S. Application Data

(63) Continuation-in-part of application No. 11/151,760, filed on Jun. 14, 2005.

(60) Provisional application No. 60/654,690, filed on Feb. 18, 2005, provisional application No. 60/579,475, filed on Jun. 14, 2004.

(51) Int. Cl.

| | |
|---|---|
| ***A61G 7/10*** | (2006.01) |
| *A61G 1/00* | (2006.01) |
| *A61G 5/00* | (2006.01) |
| *A61G 7/053* | (2006.01) |

(52) U.S. Cl. ..... 5/86.1; 5/87.1; 5/83.1; 5/89.1; 5/81.1 R

(58) Field of Classification Search ..... 5/81.1 R, 5/86.1, 89.1, 83.1, 85.1, 87.1; 212/901, 250; 254/8 R, 324, 325

See application file for complete search history.

(56) References Cited

U.S. PATENT DOCUMENTS

| | | | | |
|---|---|---|---|---|
| 2,990,899 | A | 7/1961 | DeBella | |
| 3,263,822 | A * | 8/1966 | Weinman | 212/301 |
| 3,338,323 | A | 8/1967 | Swersey | |
| 3,424,134 | A * | 1/1969 | Rosenblum | 182/3 |
| 3,521,860 | A * | 7/1970 | Zehrung, Jr. et al. | 254/8 R |
| 3,711,877 | A * | 1/1973 | Averill | 5/87.1 |
| 3,998,284 | A | 12/1976 | James | |
| 4,482,783 | A | 11/1984 | Laimins | |
| 4,799,562 | A | 1/1989 | Burrows et al. | |
| 4,875,555 | A | 10/1989 | Johansson et al. | |
| 4,926,951 | A | 5/1990 | Carruth et al. | |
| 5,022,106 | A | 6/1991 | Richards | |
| 5,033,563 | A | 7/1991 | Brainerd et al. | |
| 5,174,399 | A | 12/1992 | Brauneis | |
| 5,185,895 | A | 2/1993 | Gagne et al. | |
| 5,365,621 | A | 11/1994 | Blain | |
| 5,406,658 | A | 4/1995 | Olkkonen et al. | |
| 5,459,891 | A | 10/1995 | Reeve et al. | |
| 5,494,117 | A * | 2/1996 | Aldridge | 173/28 |
| 5,615,426 | A * | 4/1997 | Hokett | 5/89.1 |

(Continued)

OTHER PUBLICATIONS

LIKO AB, Golvo, the Mutipurpose Lift, Web site page, Jun. 27, 2006, pp. 1 of 1.

*Primary Examiner*—Peter M Cuomo
*Assistant Examiner*—Jonathan J Liu
(74) *Attorney, Agent, or Firm*—Banner & Witcoff, Ltd.

(57) ABSTRACT

A patient lift and extraction apparatus includes adjustable, generally parallel legs connected by a cross member having a support member with a projecting boom. The support member may be adjustably located between the legs. A patient lift strap in the boom supports a patient in combination with a patient sling.

22 Claims, 9 Drawing Sheets

U.S. PATENT DOCUMENTS

| | | | |
|---|---|---|---|
| 5,649,329 | A | 7/1997 | Horcher et al. |
| 5,692,253 | A | 12/1997 | Keijser et al. |
| 5,784,729 | A | 7/1998 | Dunn et al. |
| 5,878,450 | A | 3/1999 | Bouhuijs |
| 5,892,180 | A | 4/1999 | Carey |
| 5,987,664 | A | 11/1999 | Somerton et al. |
| 6,047,418 | A | 4/2000 | Seide et al. |
| 6,161,232 | A | 12/2000 | Von Schroeter et al. |
| 6,201,195 | B1 | 3/2001 | Carey |
| 6,289,534 | B1 | 9/2001 | Hakamiun et al. |
| 6,329,612 | B1 | 12/2001 | Von Schroeter |
| 6,367,103 | B1 | 4/2002 | Collins |
| 6,694,545 | B1 | 2/2004 | Renton |
| 6,806,430 | B2 | 10/2004 | Downing |
| 2004/0064886 | A1 | 4/2004 | Alverson et al. |
| 2005/0034231 | A1 * | 2/2005 | Huang ..... 5/86.1 |

* cited by examiner

FIG.12
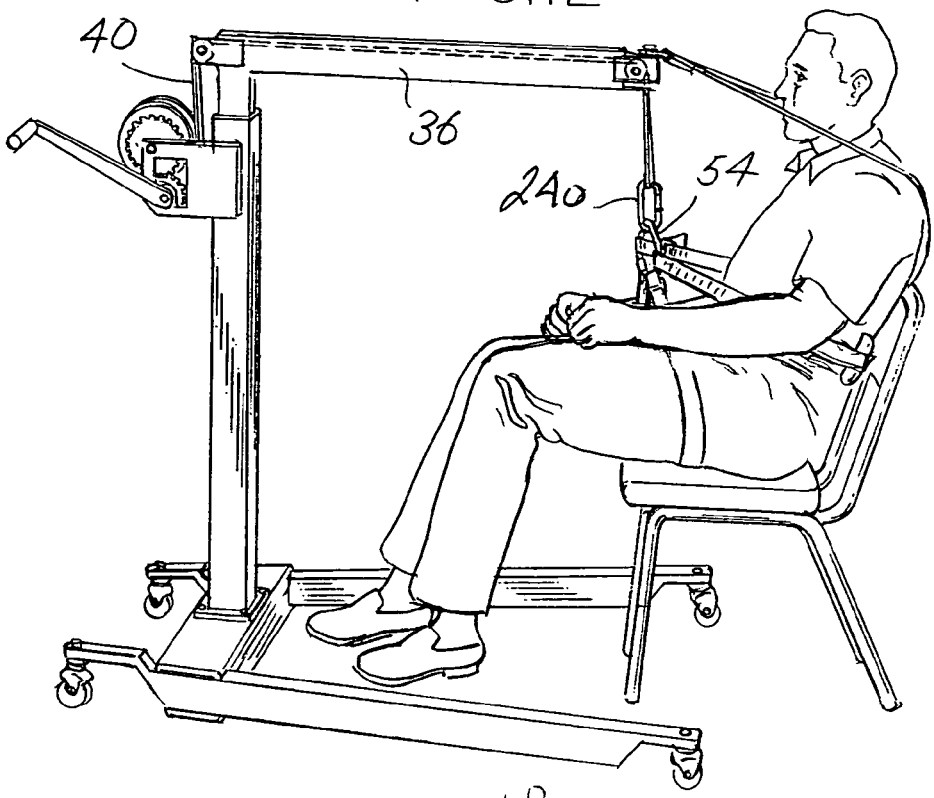
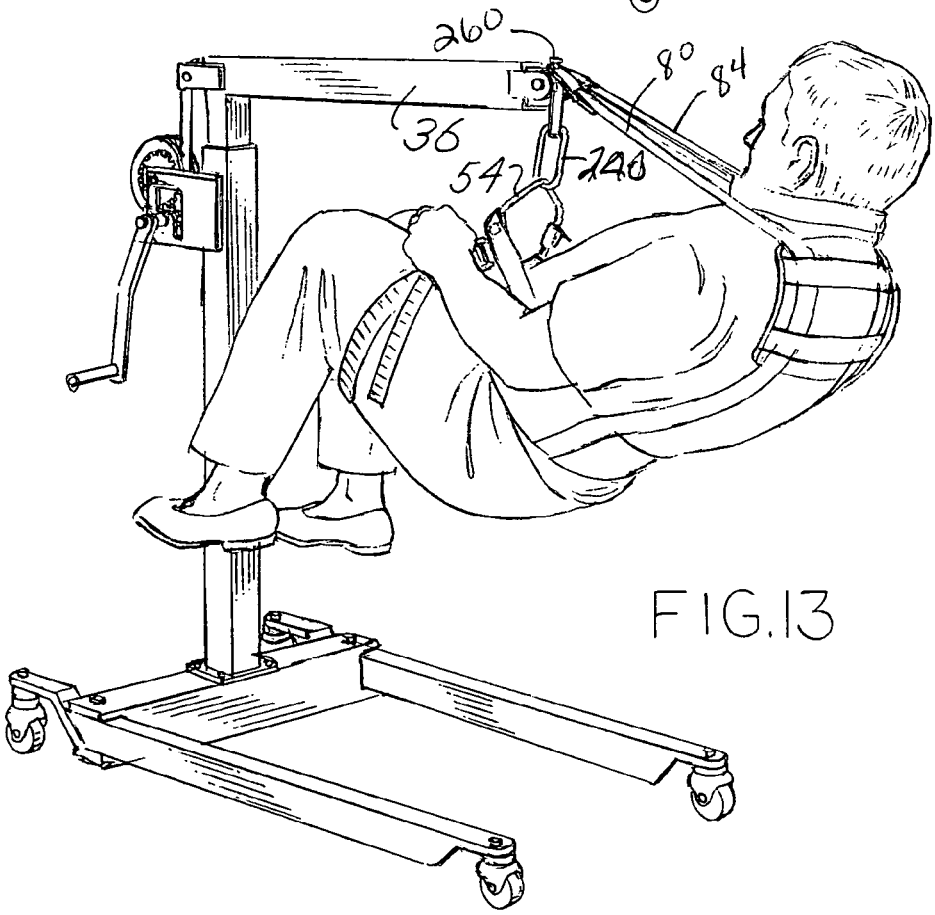
FIG.13

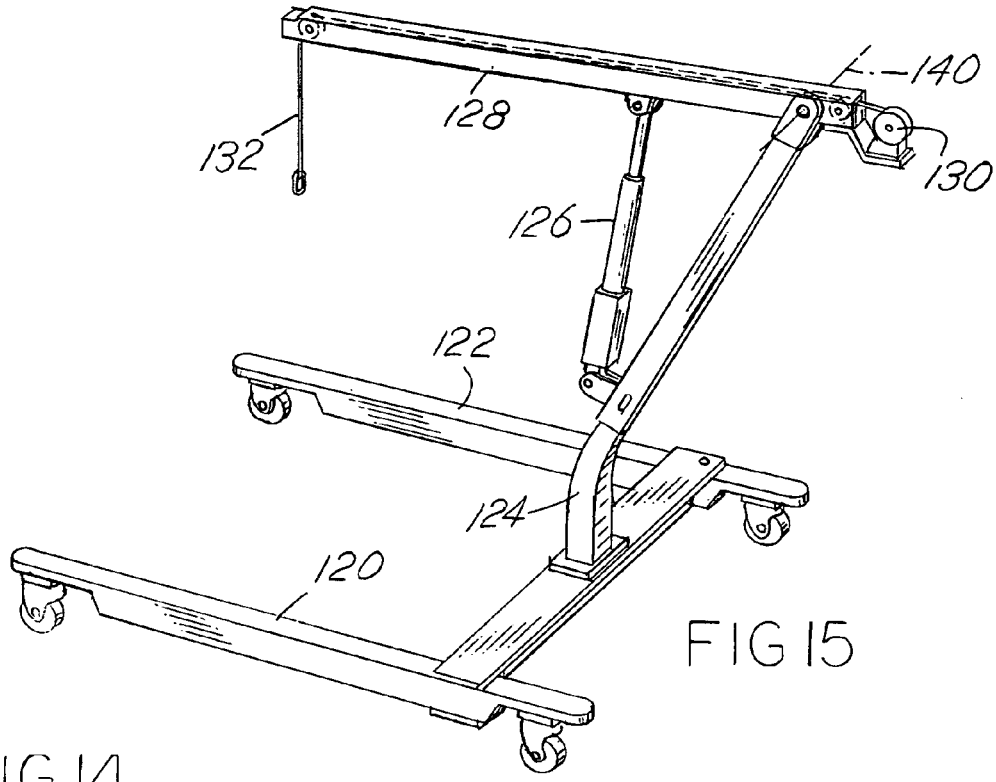
FIG 15
FIG.14
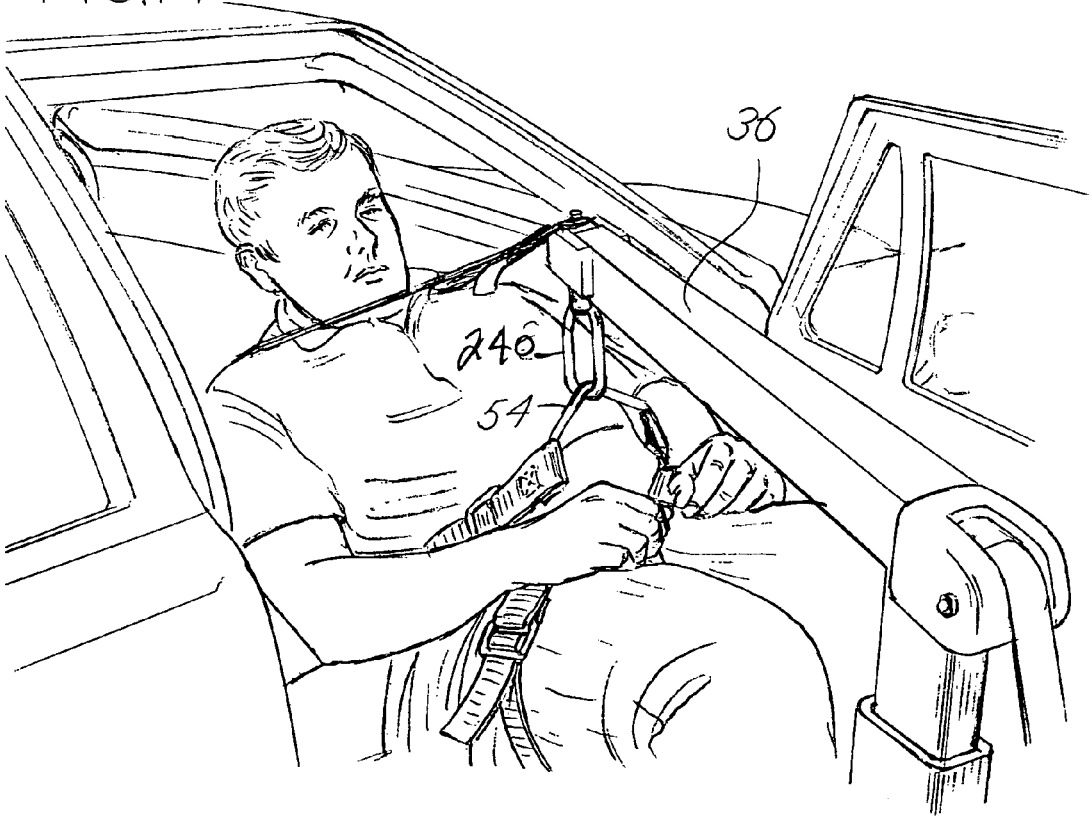

SUPPORT AND TRANSFER APPARATUS FOR TRANSPORT OF AN INCAPACITATED INDIVIDUAL

CROSS REFERENCE TO RELATED APPLICATIONS

This is a utility continuation-in-part application derived from, claiming priority to, and incorporating by reference utility application Ser. No. 11/151,760 entitled "Support and Transfer Apparatus for Transport of an Incapacitated individual", filed Jun. 14, 2005 based upon and incorporating by reference, provisional application Ser. No. 60/654,690, filed Feb. 18, 2005, entitled "Support and Transfer Apparatus for Transport of an Incapacitated Individual", and provisional application Ser. No. 60/579,475 filed Jun. 14, 2004 entitled "Support and Transfer Apparatus for Transport of an Incapacitated Individual, for which priority is claimed and which are incorporated herewith by reference.

BACKGROUND OF THE INVENTION

In a principal aspect, the present invention relates to a transport device especially useful for transport of an incapacitated individual, for example, by positioning the individual in a seat of a vehicle or by removal of an individual from a vehicle seat.

In order to avoid manual lifting of incapacitated individuals, such as hospital or health care patients, various types of lifts or supports have been developed. For example, U.S. Pat. No. 6,806,430 discloses a patient lift device which comprises a framework including spaced, horizontal legs connected by a cross frame member that supports a vertical post and patient support including a patient chair assembly, harness or sling. A patient in the chair assembly may be raised or lowered and moved by the lift construction. Thus, the patent discloses a lifting system for patients which is particularly useful in the health care field.

A problem that remains continuously vexing, however, involves movement of a patient from a vehicle or into a vehicle by means of a patient lift and assist system. Ease of movement is a challenging problem because, among other reasons, the dimensions of vehicle doors, door heights, door configurations and vehicle seat constructions vary significantly from vehicle to vehicle. The height of the space or area within a passenger compartment of vehicles also varies significantly. Thus, there have developed numerous problems of determining methodologies and providing apparatus which will facilitate movement of patients into and out of vehicles as well as into and out of other environments, or providing apparatus that is not cumbersome or difficult to use, and of providing apparatus or a device which permits carrying or movement of patients of various mobility, size and weight.

SUMMARY OF THE INVENTION

In a principal aspect, the present invention comprises various embodiments of apparatus for transport of a person, in a generally seated position and typically supported in a chair assembly or sling, into and out of a motor vehicle. The device or apparatus includes first and second horizontal, spaced legs connected by a cross frame member. The legs preferably each include wheels which may be locked to prevent rolling of the assembly or apparatus once it is desirably positioned and unlocked to permit movement of the apparatus and a patient. The cross frame member supports a generally vertical post or support element located between the spaced legs. In one embodiment, the upwardly extending support element or post is adjustably attached to the cross frame member thereby enabling lateral or side to side positioning of the post between the legs. A boom extends generally transversely from the upper end of the generally vertical support element or post. A patient support cable or strap is incorporated in the boom. The support strap is connectable to a patient sling assembly suspended from the outer end of the boom. The strap may be adjusted to raise or lower a patient in a sling or chair supported by the strap. The boom is optionally a telescoping boom. The vertical support element or post is optionally comprised of telescoping members. Mechanisms are incorporated to telescope the vertical support member and to control the release or take-up of the patient support strap and sling or chair assembly supported thereby. A locking mechanism is provided for locking the generally vertical support post at a desired location between the spaced legs. Folding handles are incorporated on the support post. The handles facilitate or enable a caregiver to more easily move the transport device or apparatus. The patient support sling includes a connection mechanism or mechanisms that effectively lock the patent sling or chair assembly to the strap and/or boom and thereby facilitate positioning of a patient in a seated or a recumbent position.

Thus, it is an object of the invention to provide a patient support device or apparatus capable of positioning a patient located in a sling onto a vehicle seat or to facilitate easy removal of a patient from a vehicle seat.

Another object of the invention is to provide a highly mobile, easily adjustable, durable patient lift and movement device.

A further object of the invention is to provide a patient lift device which includes adjustment features, such as vertical height adjustment, lateral or side to side adjustment, sling height adjustment and location adjustment.

These and other objects, advantages and features will be set forth in the detailed description which follows.

BRIEF DESCRIPTION OF THE DRAWING

In the detailed description which follows, reference will be made to the drawing comprised of the following figures:

FIG. 8 is an isometric view of the strap support and adjustment mechanism associated with the boom of the patient lift and support apparatus;

FIG. 12 is an isometric view of the improved apparatus of the invention employed to move an incapacitated individual from a seated position in a chair;

FIG. 13 is an isometric view of an incapacitated individual supported in a recumbent position by the apparatus of the invention and positioned for transport;

FIG. 14 is an isometric view illustrating placement of an individual within a vehicle by means of the apparatus of the invention; and FIG. 15 is an alternative construction for a cantilever beam support element incorporated in the apparatus of the invention.

DESCRIPTION OF THE PREFERRED EMBODIMENT

Figure 1:
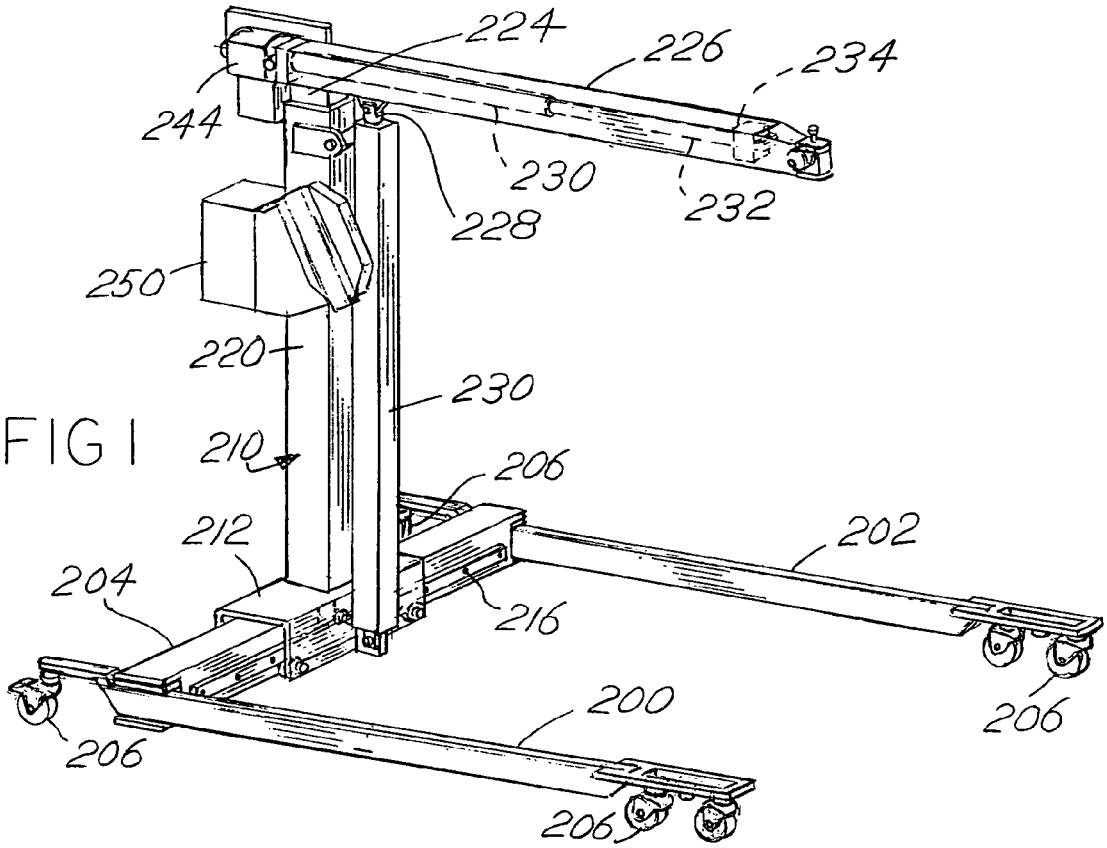
FIG. 1 is an isometric view of a first embodiment of a patient support apparatus.
Figure 2:
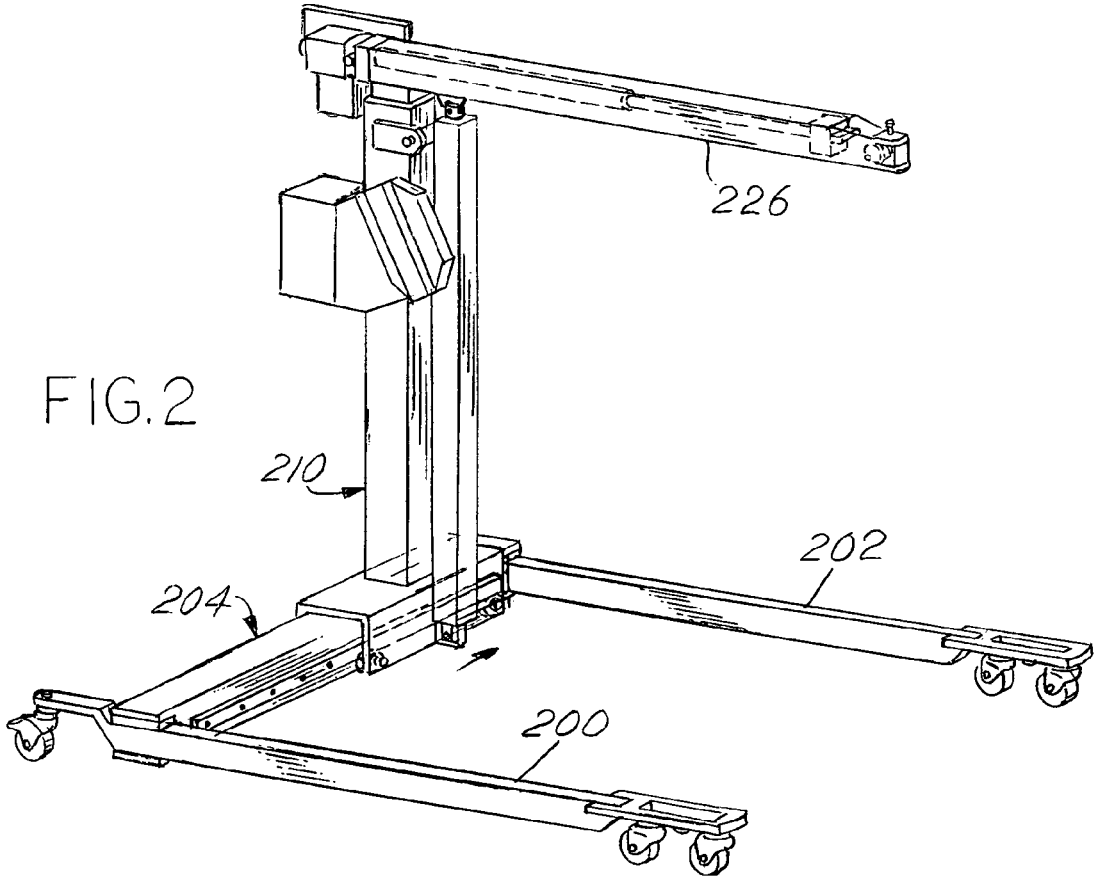
FIG. 2 is an isometric view of the apparatus of FIG. 1 wherein the intermediate, generally vertical support element is depicted as being moved laterally on a cross frame member with respect to the midpoint between generally spaced horizontal support legs.

Referring to the figures, the support apparatus of the invention is designed for removal of a person from a seated position, transport of that person in a seated or recumbent position and then placement of that person in a seated or recumbent position. The device is especially useful for removal of a person from or placement into a motor vehicle wherein, for example, the roof or door configuration of the vehicle may tend to interfere with the position of a person entering or exiting the vehicle. The device is also especially useful inasmuch as it is a mechanical device which assists lifting and movement of an individual thereby reducing or eliminating the possibility of caregiver back strain typically associated with patient movement when effected by caregivers or health workers obliged to lift and transport a patient.

FIGS. 1-8 illustrate versions of a first preferred embodiment of the invention. Thus, referring to those figures, the patient lift and support device depicted includes a first generally horizontal ground support leg 200 and a second, spaced, generally horizontal ground support leg 202. The legs 200 and 202 are spaced one from the other and may be slidably or pivotally mounted to a cross frame member 204 which connects the legs 200 and 202. Rollers or wheels 206 are preferably affixed to the opposite ends of each leg member 200, 202.

The cross frame member 204 supports a vertical or generally vertical support element or post 210 which is affixed to the cross frame member 204 by a slidable bracket 212. The bracket 212 comprises a three-sided sleeve which fits over the top and opposite sides of the frame member 204 and is slidable with respect thereto. A guide roller 215 mounted on a shaft or pin 214 is provided to slide on the topside of a rail 217 affixed to the cross frame member 204. A second roller 219 is also attached to bracket 212 and is slidable or rolls on top side of rail 217. Additional rollers 221, 223 are attached to sleeve 212 to engage and roll relative to the underside rail of 217. A similar array of rollers is attached to the opposite side of sleeve 212, enabling the sleeve 212 to slidably move along rails on opposite sides of cross beam or frame member 204. Thus, rails 217 are affixed to opposite sides of member 204. A pin or pins 225 may be used to engage a detent or opening such as opening 216 to thereby lock sleeve 212 in position and hold the vertical support element or member 210 in a fixed position on member 204 intermediate the legs 200 and 202. A series of openings such as opening 216 are provided along the longitudinal cross member 204 or frame member 204 to thereby provide for incremental, detent locking positions of the vertical support element 210 on cross frame member 204. An alternative locking and release mechanism is disclosed in FIGS. 6 and 7 discussed hereinafter.

The vertical post or support element 210 is comprised of one or preferably a series of polygonal cross section, tubular telescoping members including an outer member 220 and polygonal cross section, telescoping slidably inserted inner members 222 and 224. Typically, one telescoping member is adequate. A generally hollow, polygonal cross section tubular, horizontally extending boom 226 is affixed to the top or inner telescoping member 224. A piston actuated rod 228 associated with a cylinder 230 may be extended such as depicted, for example, in FIG. 3 to telescope the inner support members or elements 222 and 224 and thus raise or lower the generally horizontal boom 226.

The boom 226 is a generally hollow member and includes a cylinder 230 retained therein with an extendable rod 232. The rod 232 is, at its distal end 234 as shown in FIG. 8, connected to a strap 236 that fits over a pulley or roller 238 mounted on the end of the boom 226. The strap 236 typically receives a carbiner 240 at its distal end. The rod 232 may be actuated in response to the control element 244 associated with the cylinder 230 to retract the end 234 of the rod 232 and thus raise the strap 236. Movement of the rod 232 in the opposite direction will effect outward movement of the rod 232 and lowering or release of the strap 236. Operation of the various pistons and cylinders associated with the movement of the support element 210 and the boom 226 are controlled by a control mechanism retained within a control box 250.

Figure 3:
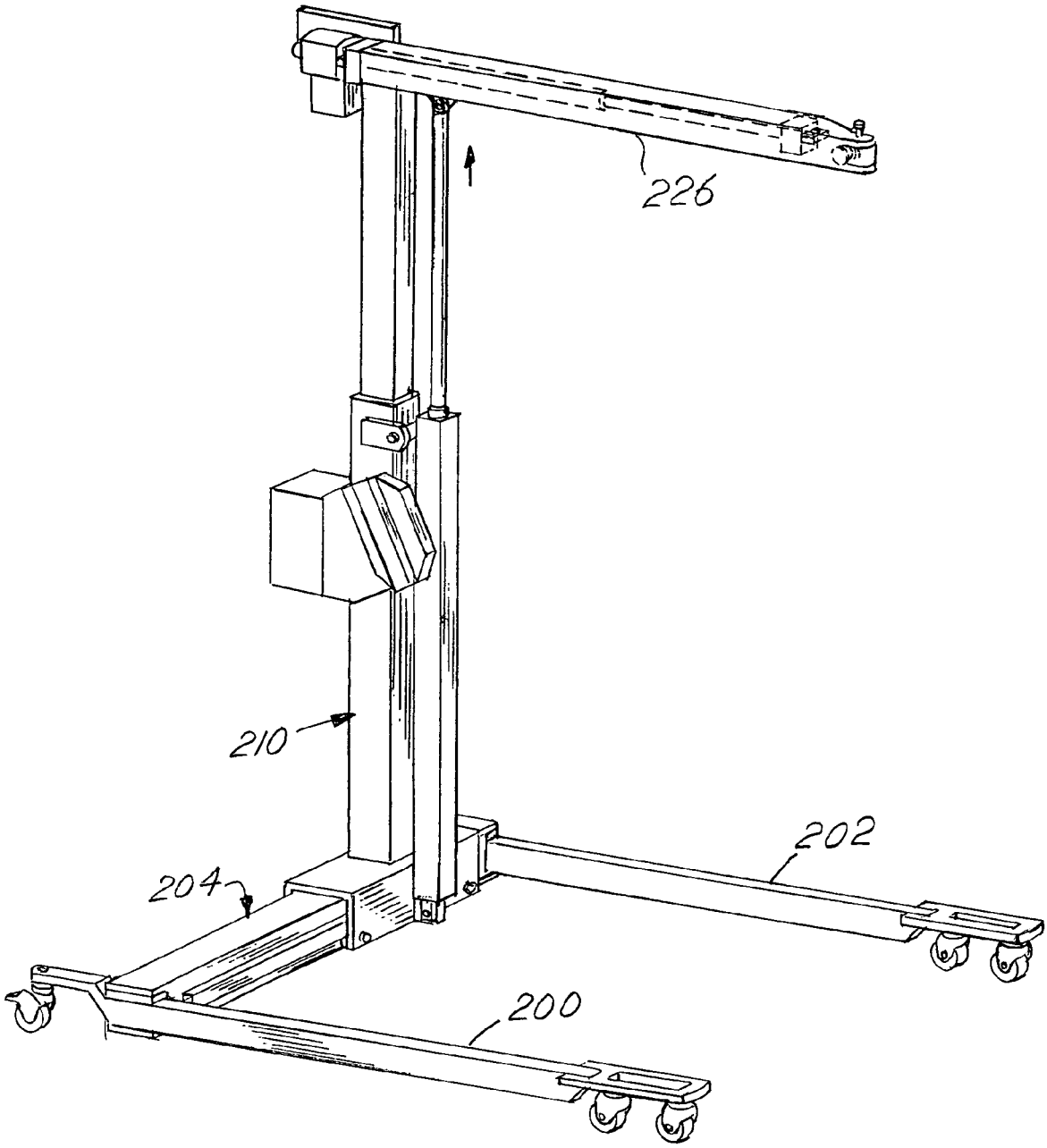
FIG. 3 is an isometric view illustrating the telescopic operation of the intermediate, generally vertical support element or post of the apparatus of FIG. 1.
Figure 4:
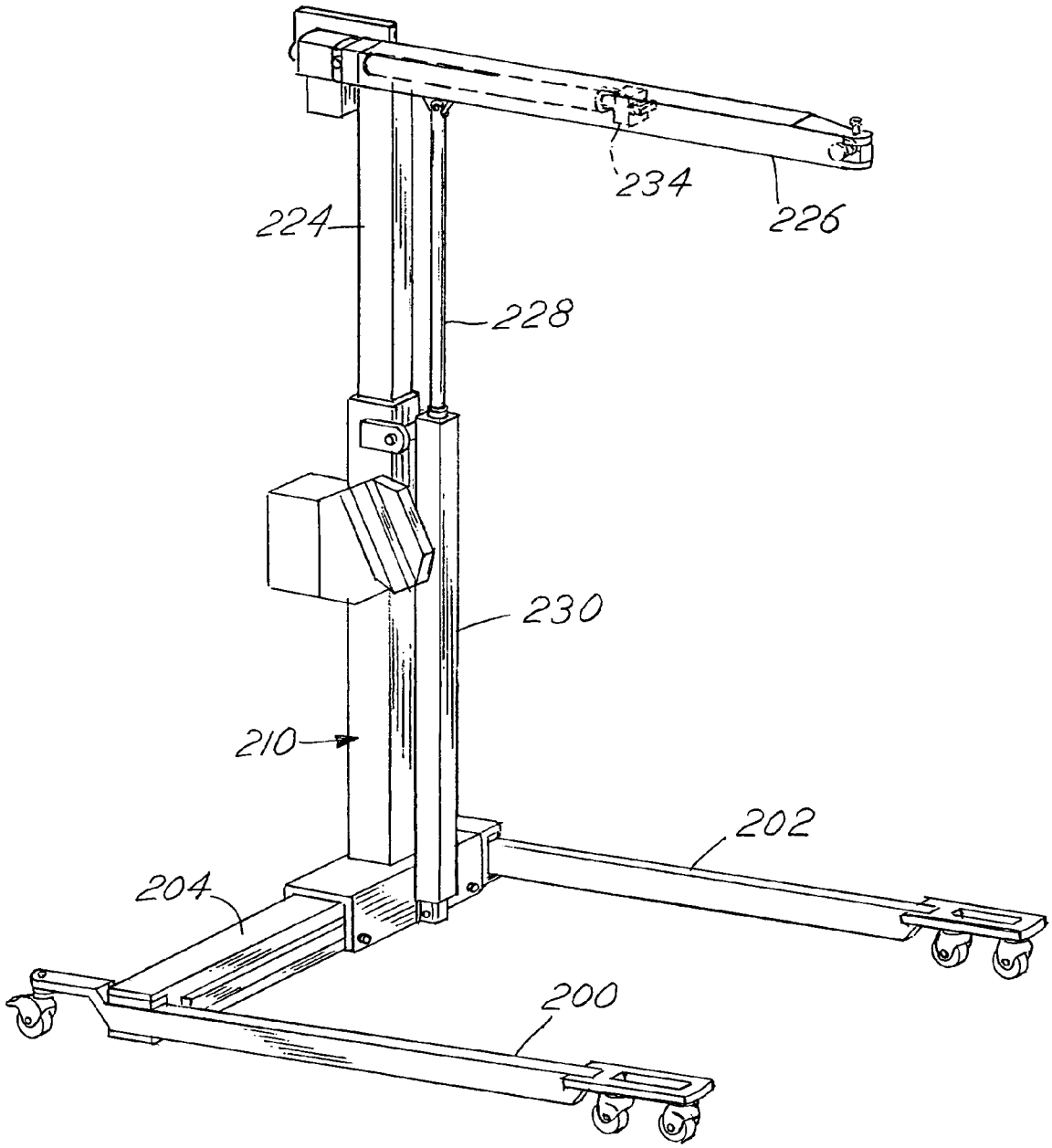
FIG. 4 is an isometric view similar to FIG. 3 wherein the mechanism which controls the extension of the flexible patient support strap is in a retracted position within the generally horizontal boom.
Figure 5:
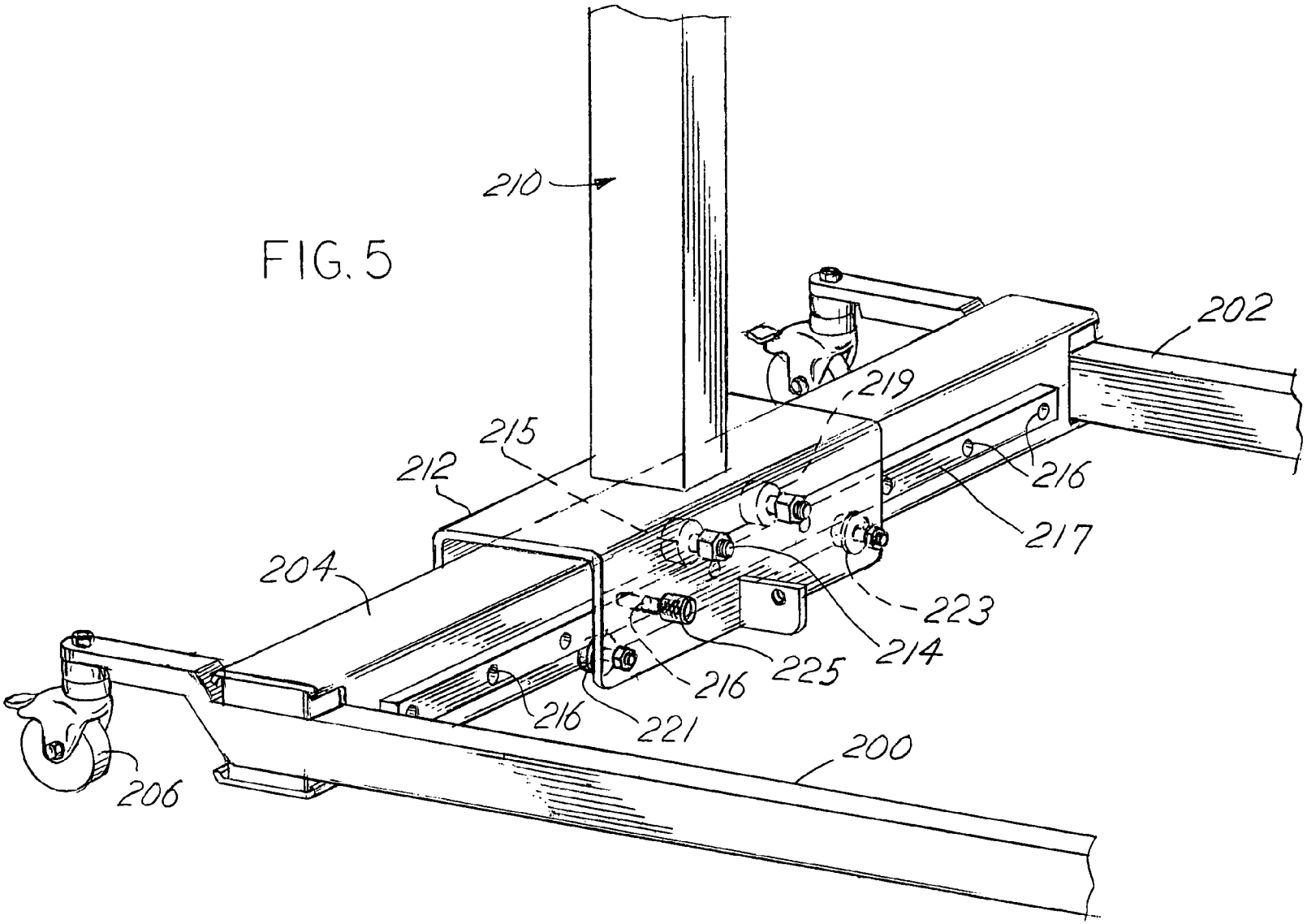
FIG. 5 is an enlarged isometric partial view of the embodiment of FIG. 1, illustrating the attachment mechanism for the generally vertical, intermediate support element or post to the cross frame member between the spaced horizontal legs of the patient lift or support apparatus.
Figure 11:
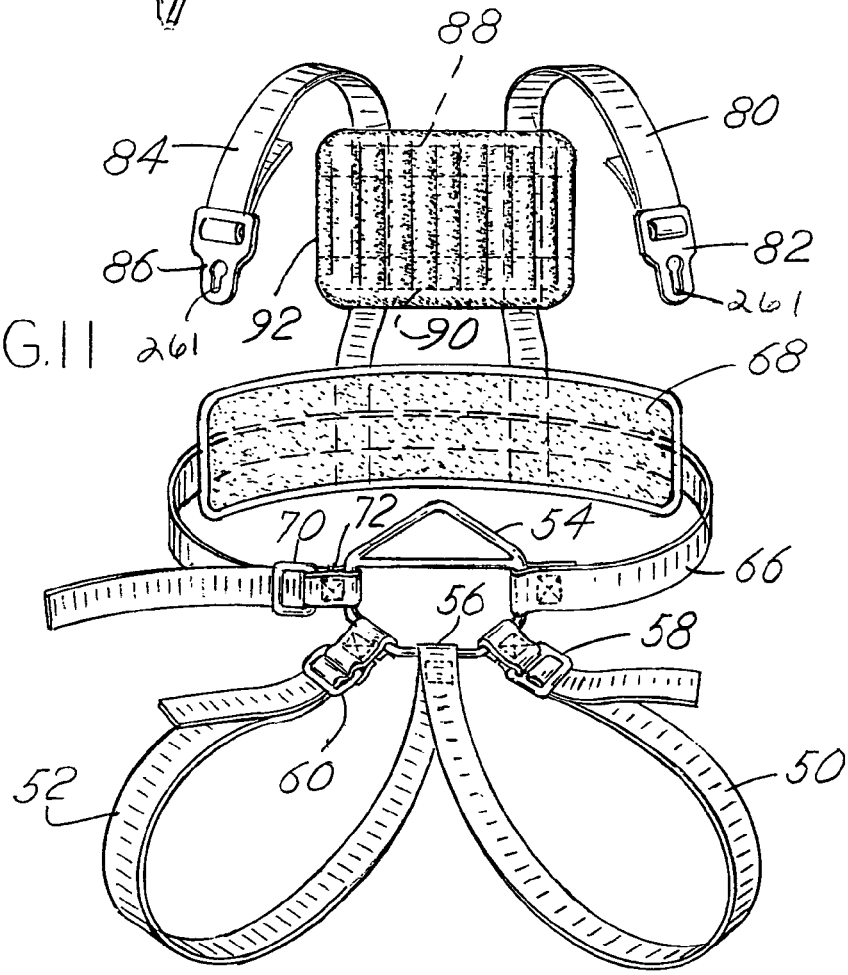
FIG. 11 is an isometric view of the sling construction associated with the apparatus of the invention.

A carbiner 240 in FIG. 3 may be attached to various support straps of a sling assembly, for example, 50, 52, 66 in FIG. 11 which support a patient such as depicted in FIGS. 12-14. Thus, patient support straps may be customized to support a patient in any one of a number of positions by cooperative engagement with either a top post 260 or with the carbiner 240 or both. For example, vertical movement of the patient is effected by operation of the rod 232 and movement of the strap 236 upwardly and downwardly over the roller 238 as separate straps 80 and 84 in FIG. 11 are attached to post 260 may effect patient movement and attitude or orientation.

Among features and functions of importance regarding the described embodiment is the length of the boom 226. That is, boom 226 is longer or extends for a greater distance from post or element 210 than employed in prior apparatus. This enables improved extension and positioning of a patient within a vehicle. An additional feature of the combined sling of FIG. 11 and the boom 226 construction is the characteristic of enabling positioning the locus of central support of a patient over the midpoint of the patient's torso. As a consequence, the patient when in a recumbent or seated position is balanced since weight is distributed about the center support, e.g. a ring 54 in FIG. 11, of the patient. This arrangement facilitates ease of movement of the patient in a balanced manner in recumbent, sitting and intermediate positions.

Figure 6:
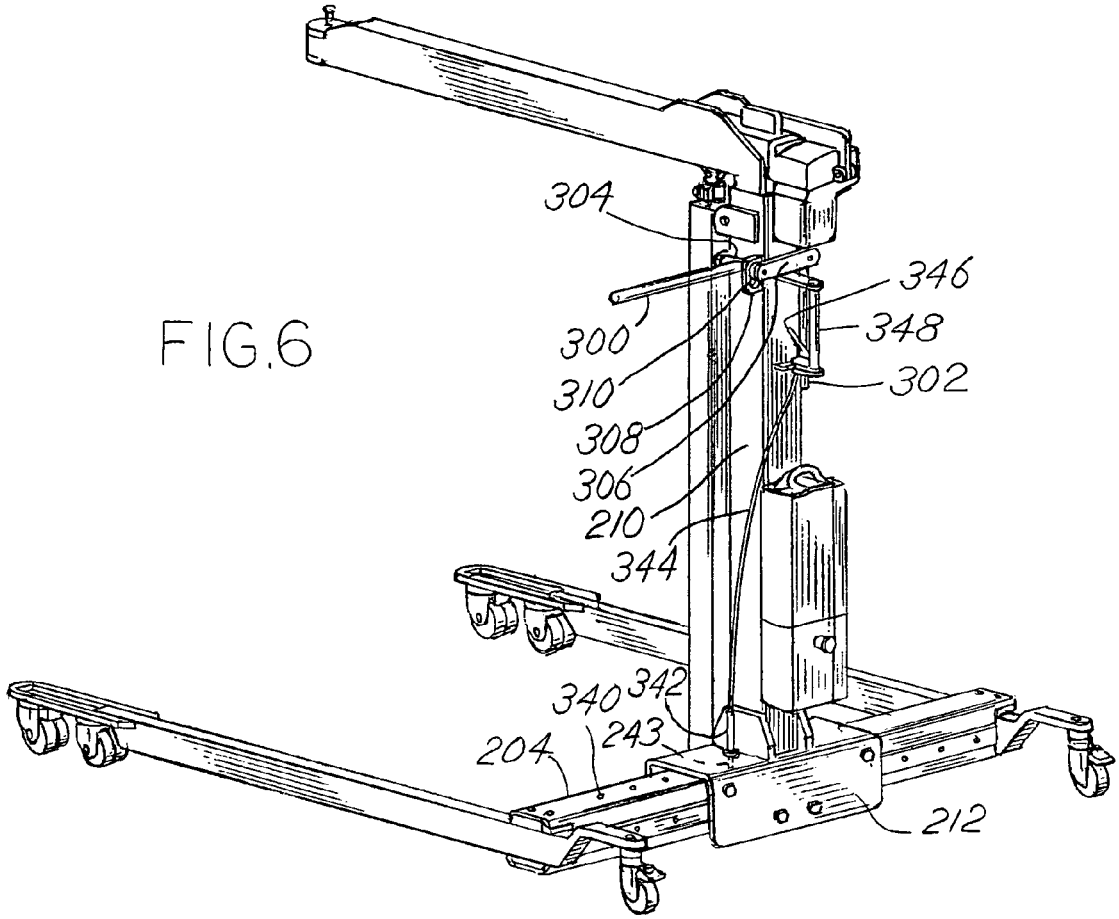
FIG. 6 is an isometric view of a preferred embodiment depicting additional features.
Figure 7:
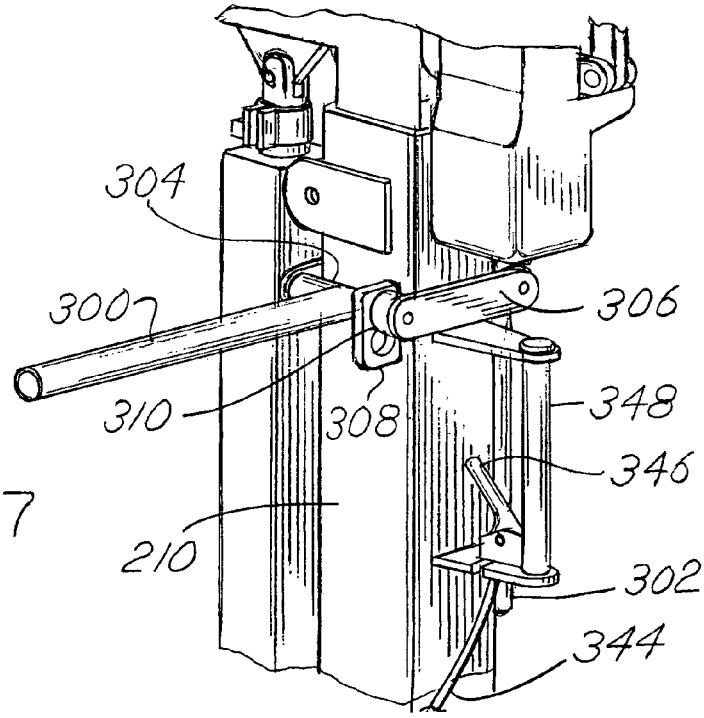
FIG. 7 is an isometric view of a part of the embodiment of FIG. 6 depicting the feature of folding handles mounted on the generally vertical support element and a locking mechanism for the generally vertical support element on the cross frame member.
Figure 9:
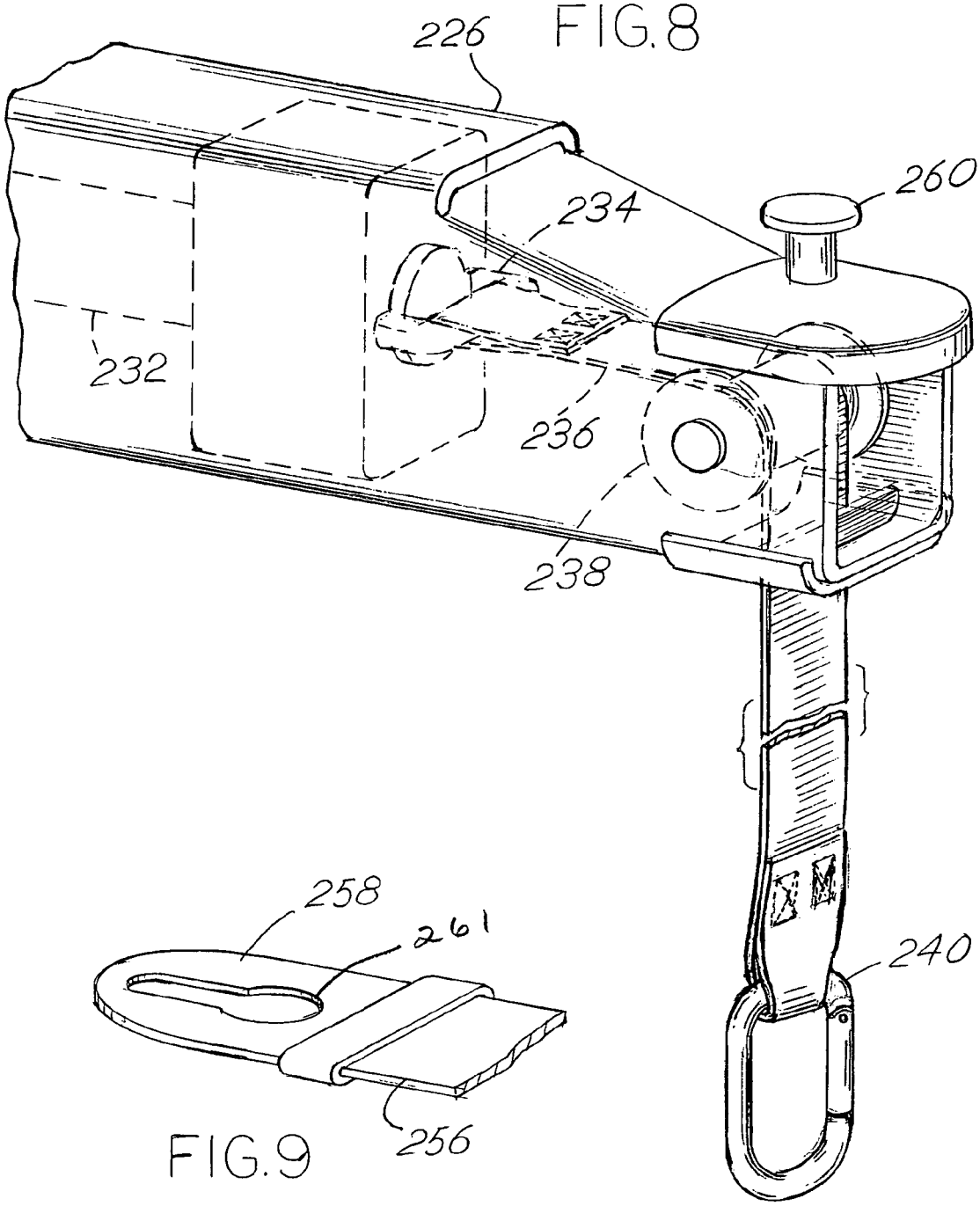
FIG. 9 is an enlarged isometric view of a first belt attachment construction which cooperates with the boom of the patient lift and support mechanism.
Figure 10:
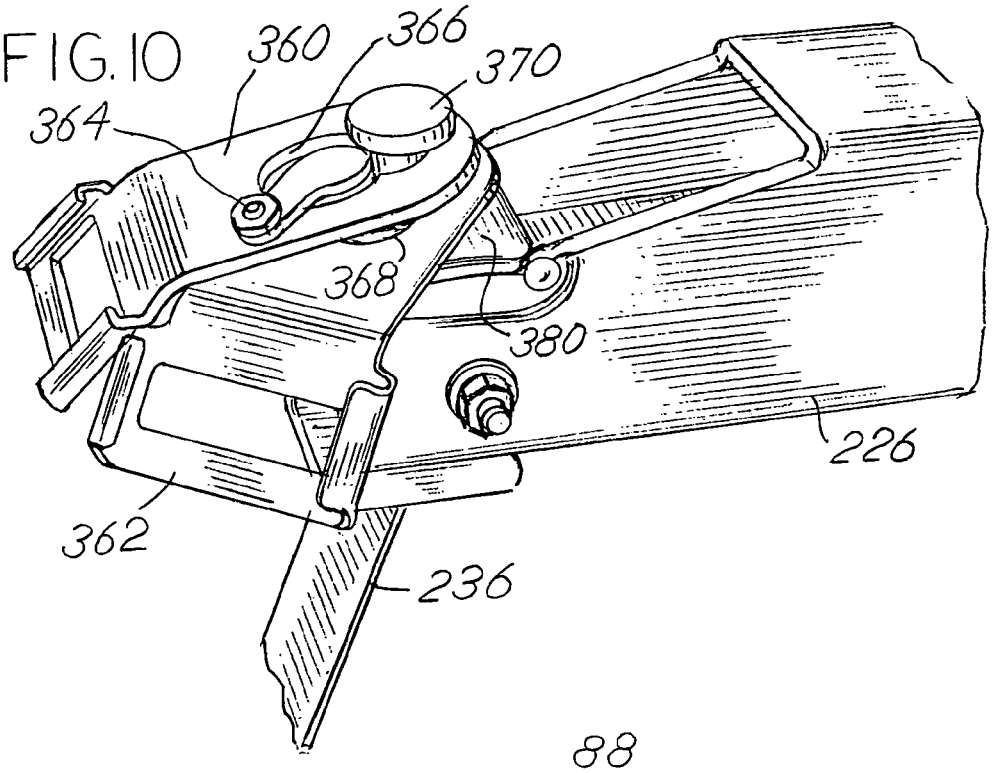
FIG. 10 is an enlarged isometric view of a second belt attachment construction which engages the generally horizontal boom.

FIGS. 6, 7 and 10 illustrate additional features of the invention. The features of FIGS. 6 and 7 include handles which are affixed to the generally vertical support post or member 210 and which may be extended or retracted when not in use.

Another feature illustrated in FIGS. 6 and 7 is the feature of an alternative mechanism for locking the center post 210 into position laterally between the legs 200, 202 of the patient support device. FIG. 10 illustrates an alternative combination of strap attachment buckles 360, 362 for straps 80, 84 which are utilized for attachment to a post 260 or 370 at the end of the generally horizontal boom 226 of the patient lift device and which interlock to facilitate maintaining the patient support sling appropriately attached to the patient lift mechanism.

Referring again to FIGS. 6 and 7, two handles 300, 302 are provided. They are attached toward the upper end of and on the opposite sides of the vertical support post or member 210. The handles 300, 302 are movable between an extended position and a retracted position. Typically, they are extended when one desires to move the patient support apparatus, particularly when a patient is positioned in a sling supported by the apparatus. Thus, the first and second handles 300 and 302 are pivotally attached by a rod, for example, rod 304 for handle 300 to a bracket 306 attached to the vertical post 210. The handle 300 may thus be rotated between a position generally parallel to and against the vertical post 210 to a position projecting laterally from the post 210. A lock plate 308 includes an internal configured passage 310 which includes a flat that fits against a flat surface of the rod 304 to maintain the handle 300 in the extended position. Thus, the slidable plate 308 will lock the handle 300 in an extended deposition, or by sliding vertically upwardly will release the handle 300 and permit it to be rotated downwardly generally against the vertical post 210. The second handle 302 is constructed and operates in substantially the same manner. The handles 300, 302 are thus extended typically when one desires to transport or move the assembly or patient support device on the support rollers 206.

FIGS. 6 and 7 also illustrate an alternative locking mechanism for maintaining the vertical post 210 in a fixed position on the cross member 204. A series of openings or passages, such as passage 340, are provided along the top face of the cross member 204. The sleeve 212 also includes a passage through the topside thereof with a guide cylinder 342 affixed thereto with an internal plunger or rod 243. The guide cylinder 342 includes a plunger 243 which fits through the opening in the sleeve 212 and can be guided into openings, such as opening 340 in cross member 204, upon appropriate alignment of the sleeve 212. A control cable 344 connects from the guide plunger 243 at one end to a pivoting trigger 346 mounted on a bracket 348 attached to the center post or generally vertical boom, or post, 210. Thus, by manipulating the sleeve 212 to appropriately align the plunger 243, maintained within the cylinder housing 342, with an opening 340 and manipulation of the trigger 346, one can lock the sleeve 212 on the cross beam or cross member 204.

Referring again to FIG. 11, the sling construction or assembly includes a first flexible strap 50 which defines a left leg support strap and a second flexible strap 52 which defines or comprises a right leg support strap. Each of the straps 50 and 52 is connected to the center of a ring element or ring 54. Thus, the first leg loop strap 50 is attached at a first end to the ring 54 at the center of the ring 54; namely, at the center section 56. The opposite end of the adjustable length strap 50 is attached by a buckle 58 adjacent the connection 56 to the ring 54. Similarly, the right hand leg strap 52 which is adjustable is attached by means of a buckle and attachment strap mechanism 60 to ring 54 adjacent the center attachment 56.

The sling assembly further includes a waist strap which comprises a flexible strap member 66 connected from one side of the ring 54 through a back support pad 68 to a buckle 70 which attaches to a strap connection 72 connected to the opposite side of the ring 54. A left hand shoulder strap 80 extends from the waist strap 66 and includes a buckle element 82 at the distal end thereof. A right hand adjustable length shoulder strap 84 includes a buckle element 86. Horizontal connecting straps 88 and 90 connect the shoulder straps 80 and 84 and space them apart one from the other so that a pad 92 supported by the straps 80 and 84 may be positioned against the back side of a patient just as the waist pad 68 may be so positioned. Choosing and adjusting the appropriate length of the various straps enables one to accommodate persons of various sizes. Thus, the spacing of the various straps can be accommodated or adjusted by means of the adjustable buckles described or the sling itself may be made in various sizes so as to accommodate persons of various size and stature.

The buckles 82 and 86 are designed to be hooked, or to be engaged, and attached to a post 260 affixed to the end of cantilever boom or arm 226. Thus, the shoulder straps 80, 84 which are adjustable in length can be adjusted so as to accommodate the angle of inclination of a patient supported by the sling strap 236 attached to a carbiner 240 and sling at the end of the arm 226. The patient may, therefore, be in any of multiple positions from a recumbent or prone position to a seated position, for example.

The strap or cable 236 is thus attached to a second clip or carbiner 240 which attaches to the ring 54. In this manner, the ring 54 may be appropriately engaged and the cable 236 tightened so as to elevate the individual seated in the chair from the chair or seat and to maintain that person at a fixed level. A chair, for example, as shown in FIG. 12, may then be removed from beneath the patient. The patient, who may then be in a partially recumbent position leaning back against the shoulder straps 80, 84, will be maintained in that position by means of the sling and in particular, the leg straps 50, 52 and waist strap 66. The combination shoulder straps 80, 84 and pads will maintain the patient in a recumbent position leaning backward as shown in FIG. 13.

Use of an operating winch or strap retraction rod effectively lifts the leg straps 50, 52 and waist strap 66 to elevate a patient slightly so that the patient may be elevated above a chair or seat. Thereafter, the entire telescoping arm 236 may optionally be elevated, for example, and in any event the patient may then be transported in an elevated position into a motor vehicle for seating. When positioned in the motor vehicle, the patient, because of the flexibility of the various belts and support mechanism, may be pivoted about the end of the arm 226. The strap 236 movement may then be reversed and the patient lowered into the seat of the vehicle. When so lowered, the various straps may be released and the patient may then be easily adjusted and situated in the motor vehicle and will resume a fully seated position.

The reverse of this operation may also be effected. That is, a patient or person may be in a vehicle and attached to the sling of FIG. 11. The person may then be slightly elevated from the seat of the vehicle and moved from the vehicle in a recumbent or partially recumbent position.

Referring again to FIG. 11, there is depicted a first arrangement for attaching straps 80, 84 to post 260. That is, the key hole opening 261 of each buckle 82, 86 may be fitted over post 260.

An alternative is depicted in FIG. 10. In FIG. 10, first and second strap buckles or strap attachment or strap attachment brackets 360 and 362 are provided for attachment respectively to straps 80, 84. A pin 364 joins the two brackets 360, 362 so that they may pivot with respect to each other. Each of the brackets 360, 362 includes a keyed opening, or passage, 366 and 368. The passages 366 and 368 may be fitted over a stud 370 of boom or arm 226 and the brackets 360 and 362 then pivoted with respect to each other to effectively lock the brackets in place on the stud 370 which includes a head and a narrow diameter shaft attached to an end bracket 380 affixed to the outside end of the boom 226. Typically, as discussed, the buckle elements 360 and 362 are associated with the ends of shoulder straps 80, 84 of a sling for a patient supported by the device. The moveable, or retractable strap 236 associated with the boom 226 is attached by means of a carbiner to the remaining portions of the strap 236 as again depicted, for example, in FIGS. 12-14 and a sling arrangement as discussed with respect to FIG. 11.

One of the benefits of the construction of the embodiments of FIGS. 1-8 is that the support beam or support element 210 may be positioned in a manner which enables the legs 202 and 200 to be offset or custom placed relative to the door or exit from a vehicle in a manner that does not interfere with the position of the tires or running gear of the vehicle. In other words, custom adjustment of the support apparatus may be effected by the lateral adjustment of the support element 210 as well as the vertical extension of that support element 210. The strap 236 may be extended or withdrawn in response to piston actuation as described. In certain embodiments, the legs 200 and 202 may be adjusted longitudinally with respect to the cross frame member 204. The wheels 208 may include a locking mechanism which holds them in position. The legs 202, 204 preferably extend generally parallel or nearly parallel to and in the same direction as boom 226 for an adequate distance to provide cantilever support of weight at the end of boom 226. The legs 200, 202 necessarily will be constructed to slide or move under a vehicle chassis. The legs 200, 202 may also be of telescoping construction. Thus, there are numerous variations of the construction of the invention which are considered to be within the scope thereof FIG. 15 illustrates an alternative cantilever arm support mechanism. In FIG. 15 horizontal support legs 120 and 122 support a vertical or nearly vertical support arm 124. The nearly vertical support arm 124 has a linear actuator 126 attached to a pivoting boom or cantilever arm 128. This arrangement further includes a winch mechanism 130 associated with a cable or strap 132. With this particular mechanism as depicted in FIG. 15, the boom 128 may be pivoted about a horizontal axis 140 to effect raising and lowering of an individual. This arrangement may result in the elimination of a vertically telescoping arm or such a mechanism could be used in combination with a vertically telescoping arm.

While there have been set forth preferred embodiments of the invention, it is to be understood that the invention is limited only by the following claims and equivalents thereof.

What is claimed is:

1. A patient extraction lift apparatus comprising, in combination:

(a) first and second generally horizontally extending, elongate, spaced, cantilever ground support legs, each leg having a first end and a second end;

(b) a cross member having first and second opposite ends, said cross member ends joined to the respective first ends of the spaced ground support legs at an interval to form a generally three sided, generally horizontal ground support frame having said spaced first and second elongate cantilever ground support legs extending generally outwardly, horizontally and forwardly from the cross member, said support legs providing cantilever support for the lift apparatus;

(c) a vertically upwardly extending, support element having a lower end mounted to the cross member generally intermediate the elongate, cantilever support legs and adjustably attached to the frame cross member solely for non-rotatable, lateral movement on the cross member in the interval between the first and second legs to enable positioning the support element at a plurality of positions intermediate the legs;

(d) an extendable telescoping member extending generally vertically upwardly from the support element, said telescoping member configured to be non-rotatable with respect to the upwardly extending support element whereby the support element and telescoping member are non-rotatably attached to the cross member;

(e) a generally horizontal boom projecting from and non-rotatably fixed to the telescoping member at a level elevated from the ground support legs and maintained extending generally transversely from the telescoping member, said boom maintained generally aligned in the direction of the ground support legs, wherein said boom may only be raised and lowered by said telescoping member sliding within said support element;

(f) a patient support extending from the boom for engaging and supporting a patient sling; and (g) a patient sling supported at least in part by said patient support, said support legs extending from said cross member to support a patient in said sling whereby a patient in said sling is transportable horizontally by movement of the lift apparatus.

2. The apparatus of claim 1 wherein the upwardly extending telescoping member is adjustable for vertical movement of a patient in said sling.

3. The apparatus of claim 2 further including a telescoping drive mechanism for the telescoping member.

4. The apparatus of claim 1 wherein the cross member includes a plurality of detent positions for retention of the upwardly extending support element at a position on the cross member.

5. The apparatus of claim 1 wherein the support comprises a strap or cable which is extendable.

6. The apparatus of claim 1 further including at least one handle attached to the upwardly extending support element, said handle foldably attached to the support element for movement between a storage position and a use portion.

7. The apparatus of claim 6 wherein the handle is pivotally attached to the support element and further including a locking mechanism for retaining the handle in the use position.

8. The apparatus of claim 6 including first and second handles each attached to the support element and foldable between a first generally vertical position parallel to the support element and a second position extending outwardly from the support element.

9. The apparatus of claim 1 further including a locking mechanism for locking the upwardly extending support member in a generally fixed position on the cross member between the first and second legs.

10. The apparatus of claim 9 wherein the locking mechanism includes an actuator mounted on the support element for releasing the locking mechanism to permit movement of the support element on the cross member.

11. The apparatus of claim 1 wherein the patient support comprises a strap which includes an inside end and an outside end, said outside end including a mechanism for attachment to said patient sling.

12. The apparatus of claim 11 wherein the inside end of the strap is attached to a rod mounted in the boom and said boom includes a rod movement mechanism for withdrawing or extending the rod and thereby cause, respectively, a retraction or extension of the strap.

13. The apparatus of claim 11 wherein the mechanism for attachment includes first and second pivotally connected overlapping plates.

14. The apparatus of claim 1 wherein at least one of said ground support legs is pivotably attached to the cross member.

15. The apparatus of claim 1 wherein said sling comprises;

a first under leg strap, including connectable opposite ends;

a second back support strap having opposite ends connectable at a juncture to the under leg strap; and said straps connectable at said juncture to the patient support strap.

16. The apparatus of claim 15 further including first and second shoulder straps, each shoulder straps extending from the back strap to a distal end attachable to the boom, said leg strap, back strap and shoulder straps forming a harness.

17. The apparatus of claim 16 further including a second under leg strap having connectable opposite ends, said second under leg strap also connectable to the juncture.

18. The apparatus of claim 16 wherein the boom includes a support post at an end of said boom, and said shoulder straps each include an end attachment plate with a key slot for engaging said post.

19. The apparatus of claim 1 wherein the support element includes a sleeve at the lower end, said sleeve slidably mounted on the cross member, said sleeve and cross member configured to maintain said sleeve non-rotatably engaging the cross member.

20. The apparatus of claim 19 further including multiple detent positions for connecting the sleeve and cross member.

21. The apparatus of claim 1 wherein the support element and telescoping element have a polygonal cross section.

22. The apparatus of claim 1 further including rollers mounted to said support legs.

* * * * *